US007190886B2

(12) United States Patent
Dubicki et al.

(10) Patent No.: US 7,190,886 B2
(45) Date of Patent: Mar. 13, 2007

(54) INSTANTANEOUS ELECTRIC WATER HEATERS

(76) Inventors: Paul Dubicki, 27 Norway St., Milford, CT (US) 06460; William Newbauer, Jr., 20 Putney Chapel Way, Stratford, CT (US) 06607; William Newbauer, III, 244 Galloping Hill Rd., Fairfield, CT (US) 06430

( * ) Notice: Subject to any disclaimer, the term of this patent is extended or adjusted under 35 U.S.C. 154(b) by 0 days.

(21) Appl. No.: 10/339,224

(22) Filed: Jun. 17, 2003

(65) Prior Publication Data

US 2004/0258402 A1 Dec. 23, 2004

(51) Int. Cl.
*H05B 3/60* (2006.01)

(52) U.S. Cl. ..... 392/326; 392/311; 392/485

(58) Field of Classification Search ..... 392/311, 392/322–326, 335, 337, 441, 465, 466, 451, 392/448, 485

See application file for complete search history.

(56) References Cited

U.S. PATENT DOCUMENTS 5,400,432 A * 3/1995 Kager et al. ..... 392/492
6,173,118 B1 * 1/2001 Harris ..... 392/451
6,516,142 B2 * 2/2003 Grant et al. ..... 392/451
6,701,069 B1 * 3/2004 Cezayirli et al. ..... 392/490

* cited by examiner

*Primary Examiner*—Thor Campbell

(57) ABSTRACT

This invention relates to an electric water heater comprising one or more heating resistors and the means for supplying and controlling electric power supplied to the resistors. The heaters of the present invention are capable of heating incoming water to a desired temperature in the time period required for the input water to flow from the heater water inlet to the heater water outlet, thus requiring no storage capacity. Further, high electrical power consumption, normally associated with on demand or instantaneous electric water heaters is reduced by powering only such of the heating elements as may be required to meet demand. In addition, the heaters of the present invention utilize innovative cartridge heating elements which drastically reduce maintenance time and expense by allowing for the removal and replacement of the spent or defective heating elements from the air side of the flange, as opposed to the wet side, thereby eliminating the need for draining or disassembling of the unit during servicing.

10 Claims, 6 Drawing Sheets

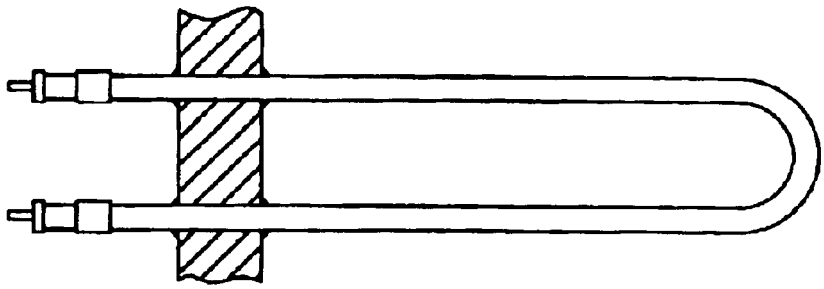
FIG. 1a
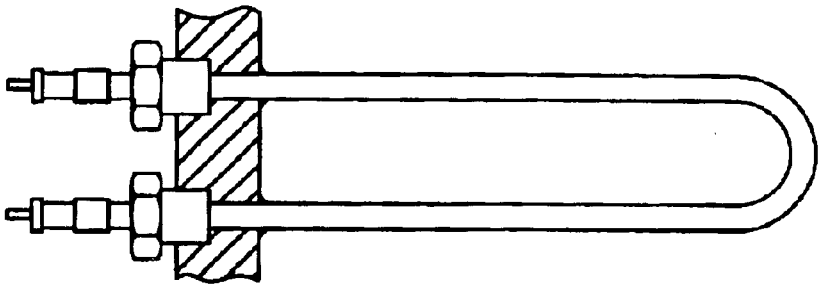
FIG. 1b
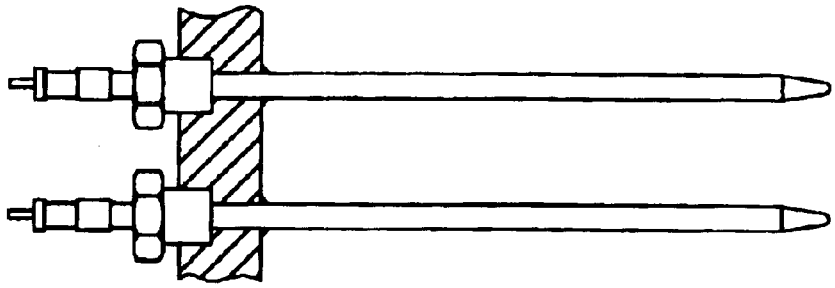
FIG. 1C
FIG. 1

INSTANTANEOUS ELECTRIC WATER HEATERS

FIELD OF INVENTION

This invention concerns improvements in and relating to water heating apparatus for use in any type of application i.e. commercial, industrial and marine applications.

More particularly the invention concerns improvements in the use of medium to high recovery electric water heaters for supplying potable hot water on board combatant ships.

Further, the invention is concerned with such heaters which use the medium of water for the heating effect of the electric current.

PRIOR ART

A large amount of electric water heating, in the vast majority of commercial, industrial and marine applications, is presently accomplished by means of thermostat controlled electric heating of water held in a drum or tank. This method allows the water to be heated at a relatively slow rate by a relatively low capacity heater with the heated water being stored in the drum or tank at the required temperature until needed.

The serious disadvantages of these systems, in addition to low efficiency due to heat loss from the heated water in the drum or tank, since the water must be held at a relatively high temperature largely continuously, is that the water heater combined with the stored water represent significant weight and take up considerable amounts of space due to the need for hot water storage capacity.

Demand or instantaneous water heaters, i.e. water heaters that heat incoming water to desired output temperatures in the time period required for the water to flow from the heater water inlet to the heater water outlet, thus requiring no storage capacity, such as described in the U.S. Pat. Nos. 5,033,107 and 4,851,646 are in use on a relatively small scale. The heating elements in these units heat water only when the flow of water through the units is initiated. These units require relatively high electrical power supply levels if a large flow of hot water is required.

SUMMARY OF THE INVENTION

The design of the high recovery demand or instantaneous water heaters of the present invention is primarily driven by the initiative to remove steam water heaters currently in use on board combatant ships and to replace them with highly efficient demand or instantaneous electric water heaters which require no hot water storage capacity. However, it should be understood that the demand or instantaneous electric water heaters of the present invention are not limited in use to marine applications.

As noted previously, typically, electric water heaters have been designed as storage type water heaters. These heaters take up considerable pace and add unacceptable weight, and have high maintenance requirements in terms of manpower needed to repair and service the equipment.

In addition, in the case of combatant ships, the need for equipment to be fully shock and vibration designed and tested is critical to the successful operation of the equipment under battle conditions. Further there is a desire to reduce space and weight requirements by reducing the number of spare parts needed to service heaters.

The heaters of the present invention are configured with the foregoing goals in mind. The heaters of the present invention utilize the concept of a demand or instantaneous water heater i.e. a water heater that heats incoming water to a desired temperature within the time required for the water to flow from the water heater's water inlet to the water heater's water outlet, thereby not requiring any hot water storage capacity. In accordance with the present invention, selective actuation of one or more innovative heating elements consisting of individual non-hairpinned heating elements threaded into the airside of a flange allows for the meeting of heated water demand as well as the elimination of less efficient electrical power usage and high maintenance costs normally associated with storage type electric water heaters.

Additionally, the water heaters of the present invention can be configured to cover virtually any water heating requirement. Moreover, by using the same components, across a wide range of heater sizes, spare parts storage and maintenance requirements are greatly reduced.

An additional aspect of the present invention is a design employing placement of the heating elements which drastically reduces maintenance time and expense by allowing for the removal and replacement of spent or defective heating elements from the air side of the flange, thus requiring no draining of the heater and without disconnecting electrical connections except for the two power wires to the particular element.

The electric water heaters of the present invention require more frequent cycling of the electrical load than traditional electric storage type water heaters. The highly responsive control system of the present invention maintains accurate temperature control over a wide range of water flow rates through the use of silicon control rectifiers (SCR) rather than standard electro-mechanical magnetic contactors.

The switching life of an SCR is approximately 1 billion cycles versus 50 thousand cycles for the electrical contacts of a standard electro-mechanical magnetic contactor. The maximum SCR switching cycle is once per second while the standard electro-mechanical switching cycle, in the present application, would be approximately once every 5 minutes. Using the stated switching cycles, the SCR has an estimated useful life of 32 years as compared to an estimated useful life of approximately 6 months for the standard electro-mechanical magnetic contactor. As a result of the SCR's ability to switch loads once per second, the water heaters of the present invention function more efficiently and maintain more precise temperatures in comparison to water heaters employing standard electro-mechanical magnetic contactors. On the other hand the significantly longer cycle time of the standard electro-mechanical magnetic contactor results in a control package which is unable to maintain as safe and accurate hot water temperatures, in comparison to the control package of the present invention.

Further the SCR system utilized in the present invention does not require the use of electromagnetic interference filters. The SCR is a zero crossover type, i.e. the electrical switching is completed only when the phase angle of the alternating current is zero, thereby eliminating arcing within the controls. This is not the case with standard electro mechanical magnetic contactors.

Moreover, an SCR control system is significantly lighter than a standard electro-mechanical magnetic contactor system. A magnetic contactor system with the equivalent amp rating of an SCR system will weigh approximately 3 and ½ times as much as an SCR system.

Lastly, an SCR control system is significantly less expensive than a magnetic contactor system. A standard electro-mechanical magnetic contactor system with the equivalent amp rating of an SCR system will cost from 3 to 5 times more than an SCR system.

Possibly the most innovative aspect of the present invention is found in the use of individual non-hairpinned cartridge heating elements which can be threaded into the air side of the flange.

The most common maintenance issue for electric water heaters is the replacement of the heating element. Applicants, in their experience, estimate that heating element replacement accounts for approximately seventy-five percent (75%) of all maintenance service work performed on any water heater.

Traditional heating element designs include the so-called standard design, identified as FIG. 1-*a* in FIG. 1 of the accompanying drawings. This standard design consists of individual hairpinned tubular, (usually copper or stainless steel based alloy) heating elements that are brazed or welded into a flange. In the event of a failure in this type of element, requiring replacement of the element, power must be disengaged from the heater, the water supply turned off, the heater must be drained, all electrical connections broken at the flanged assembly, and the entire flanged assembly must be completely removed. For all practical purposes, this type of element is non-repairable since a complete new flange assembly has to be installed and re-wired. The cost of this replacement can range from about 4 to 30 times the cost of replacement of the cartridge element employed in the present invention.

A second traditional heating element design, identified as FIG. 1-*b* in FIG. 1 of the accompanying drawings, is the so called replaceable blade element. This heating element is made up of individual hairpinned tubular, (usually of a copper or stainless steel alloy), heating elements that are held into a flange with a threaded compression fitting and are designed so that upon failure of a single hairpinned element, the entire flanged assembly must be removed and the faulty or spent hairpinned element removed from the water side of the flange. There are significant labor requirements since the entire element/flange assembly must be removed from the heating vessel prior to removing and replacing the spent or defective tubular hairpinned element. The cost of this replacement runs from about 8 to 10 times the cost encountered replacing the single replaceable cartridge element of the present invention.

In the case of the present invention, the innovative design consists of individual non-hairpinned cartridge heating elements, threaded into a flange and identified as FIG. 1-*c* in FIG. 1 of the attached drawings. If a failure occurs, involving one or more elements, only the spent or defective element(s) need be replaced. Since the elements of the present invention are not hairpinned, they can be removed from the air side of the flange without draining the unit and without disconnecting all of the electrical connections. Maintenance in this case is significantly reduced, simply requiring only the disengagement of power to the unit, shutting off the water supply, disconnecting the two power lines to the individual element, unscrewing and removing the element, then installing the replacement element in reverse fashion.

The heaters of the present invention are provided with two (2) thermocouples which in combination with the use of SCRs discussed above avoids significant safety, maintenance and operational issues. Thermocouple number one is a temperature controller which monitors the water temperature exiting the unit.

Thermocouple number two is the high-limit water temperature controller and is provided to detect water over-temperature as a safety feature. The high-limit water temperature controller will activate an external shunt-trip circuit in a remote circuit breaker should water over-temperature occur in the unit.

An ultrasonic low water cut out device is employed to verify water level within the vessel. This low water cut out will activate an external shunt trip circuit in a remote circuit breaker should the water level drop below a predetermined level. This is used to ensure that the heating elements are not energized and subsequently damaged in a low or no water condition.

In summary the water heating apparatus of the present invention comprises one or more of the innovative heating elements, designed for connection to a source of electrical power, with means to control distribution of the electrical power, immersed in water to be heated, and temperature detection devices designed to:

a) detect the output temperature of the heated water;
b) detect water over-temperature as a safety feature; and
c) detect a low water condition.

The foregoing and other features and advantages of the present invention will become more apparent when taken in connection with the accompanying drawings which show for purposes of illustration embodiments of the present invention wherein:

FIG. 1 is an illustration of typical element designs including the replaceable cartridge element of the present invention FIG. 2 is a control panel layout for a typical 340 kW heater of the present invention. Heaters with less power (kW) will have fewer fuses and SCRs and a smaller power distribution block due to the lower amperages involved and conversely FIG. 3 is a wiring diagram for a typical 340 kW heater of the present invention. Heaters with less power (kW) will have fewer fuses and SCRs and a smaller power distribution block due to the lower amperages involved and conversely FIG. 4 is a plan view of a heater of the present invention FIG. 5 is a top view of the flanged heater unit of the present invention FIG. 6 is a cut-away side view of the flanged heater unit of the present invention Looking in greater detail at the accompanying drawings, FIG. 1 at FIG. 1-*c* is a hermetically sealed immersion electric heater element employed in the present invention. The element is designed with a maximum watt density of 50 watts per square inch in accordance with MIL-H-22577 in order to prolong the life of the heating element. The tubular sheathing of the element is preferably Incoloy which offers greater corrosion resistance and higher operating temperatures than can be achieved with standard copper sheathing.

FIG. 2 The power distribution block is sized for the full operating load i.e. all heating elements are wired to a power distribution block representing a single circuit and provides for easy power connections. A terminal block is provided for connection of 120 volt control power. The terminal block also provides connections for an external switch as well as connections to a shunt-trip circuit breaker. The external switches provide for indicators which allow operators to remotely monitor fault conditions.

Each circuit is controlled by two (2) zero cross-over fired silicon control rectifiers (SCR) to increase reliability and minimize electromagnetic interference. SCRs are mounted through the side of the control panel and onto a heatsink to facilitate removal of heat caused by switching action of the SCRs.

Each circuit is protected by three (3) fast acting fuses, one on each leg of each circuit.

FIG. 3 the wiring diagram, for a 340 KW heater. Note that two (2) power inputs are employed, 460-volt for heater power and 120-volt for control power.

FIG. 4 illustrates the arrangement of the components of the water heater embodying the present invention.

The electrical control panel (1) with heat sinks (2) shall be rated NEMA 4 and may be constructed of any suitable material, preferably of all stainless steel construction, and is mounted on support plates (3) through supports (4) to cylindrical vessel (5). Alternatively the control panel may be mounted at a place remote from the heater, i.e. on a bulkhead, provided appropriate modifications of heater power conduit (11) and thermocouple conduit (12) are made. The heat sinks (2) are attached to the control panel (1) in order to reduce thermal stress on electrical components. The heater design is based on operation at an ambient air temperature of 110 F. However, ambient air temperatures for the heater locations should be as low as possible. Air conditioning of the heater spaces is preferred however, if not possible or practical, the heater spaces should at least be adequately ventilated.

The cylindrical vessel (5) is constructed of any suitable material which will resist corrosion by hot water and fatigue. A vessel made of 90/10 copper nickel alloy, long acknowledged by the Navy for its superior resistance to corrosion and fatigue, and its ability to last as long as the useful life of a ship is the preferred material for construction of the vessel. The cylindrical vessel (5) is normally approximately 8 to 12 inches in diameter and approximately four (4) feet tall. The vessel (5) is designed and manufactured and stamped in accordance with ASME code and desirably should be stamped "certified and registered with the National Board of Pressure Vessel Inspectors".

The vessel (5) is designed for a 125 psi working pressure and hydrostatically tested at 188 psi (one and one-half times the working pressure).

A mounting plate (7) and gussets are welded to the bottom of vessel (5) to provide optimal support for vessel (5) during operation in a shock and vibration environment as typical in a combatant situation.

A union connection water inlet (8) approximately one inch in diameter and a water outlet (9) also approximately one inch in diameter are welded into the lower and upper end of vessel (5) respectively.

A union connection, not shown, is supplied in vessel (5) for a bronze ASME rated combination temperature and pressure safety relief valve. This valve is set at the vessel working pressure and should discharge at 125 psi and/or 210 F.

A flange (10) is welded to the top of vessel (5) in order to receive the flanged heater unit (6). Power conduit (11) and thermocouple conduit (12) connect the heater unit (6) to electrical control panel (1).

Figure 2:
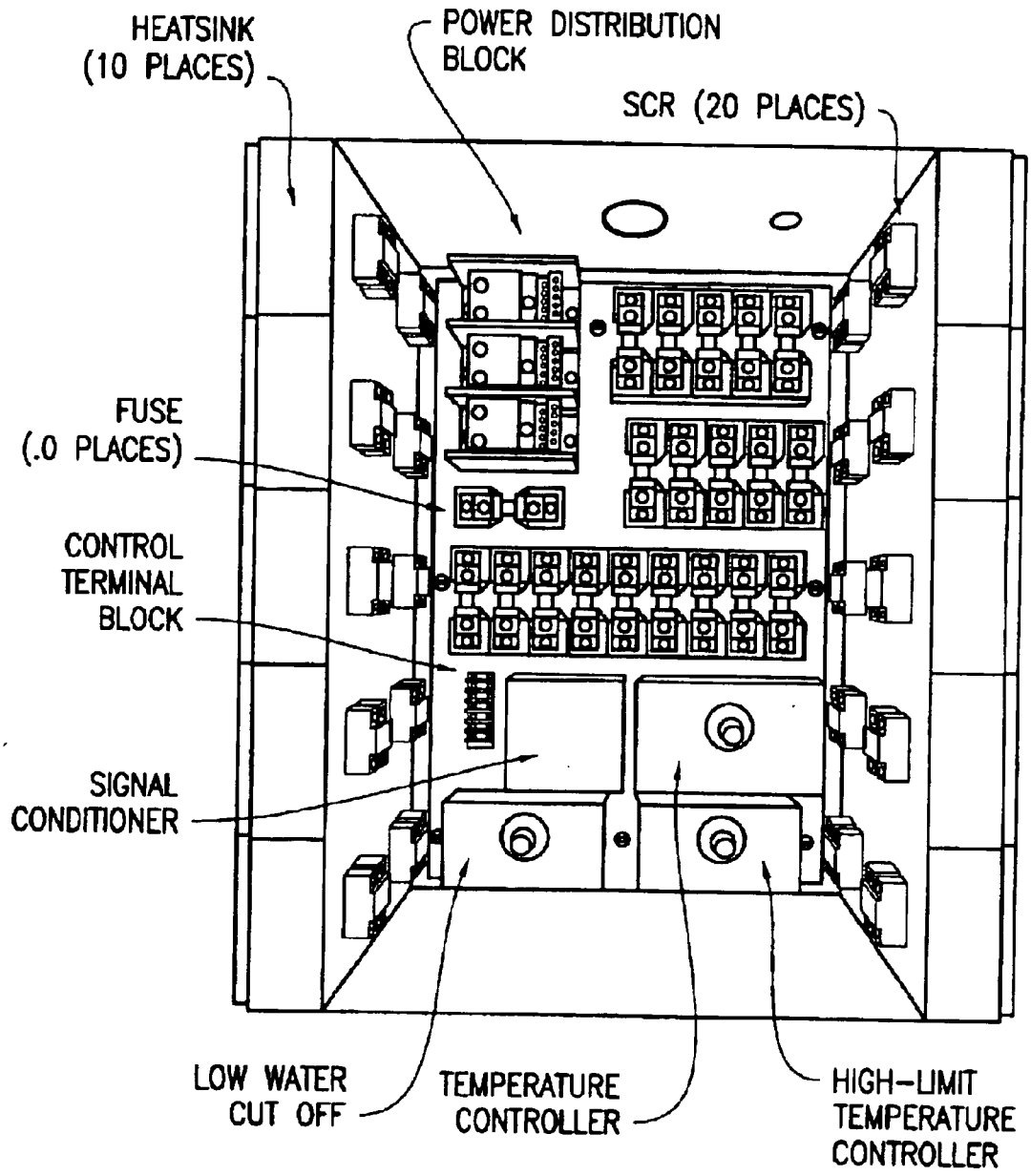
Figure 3:
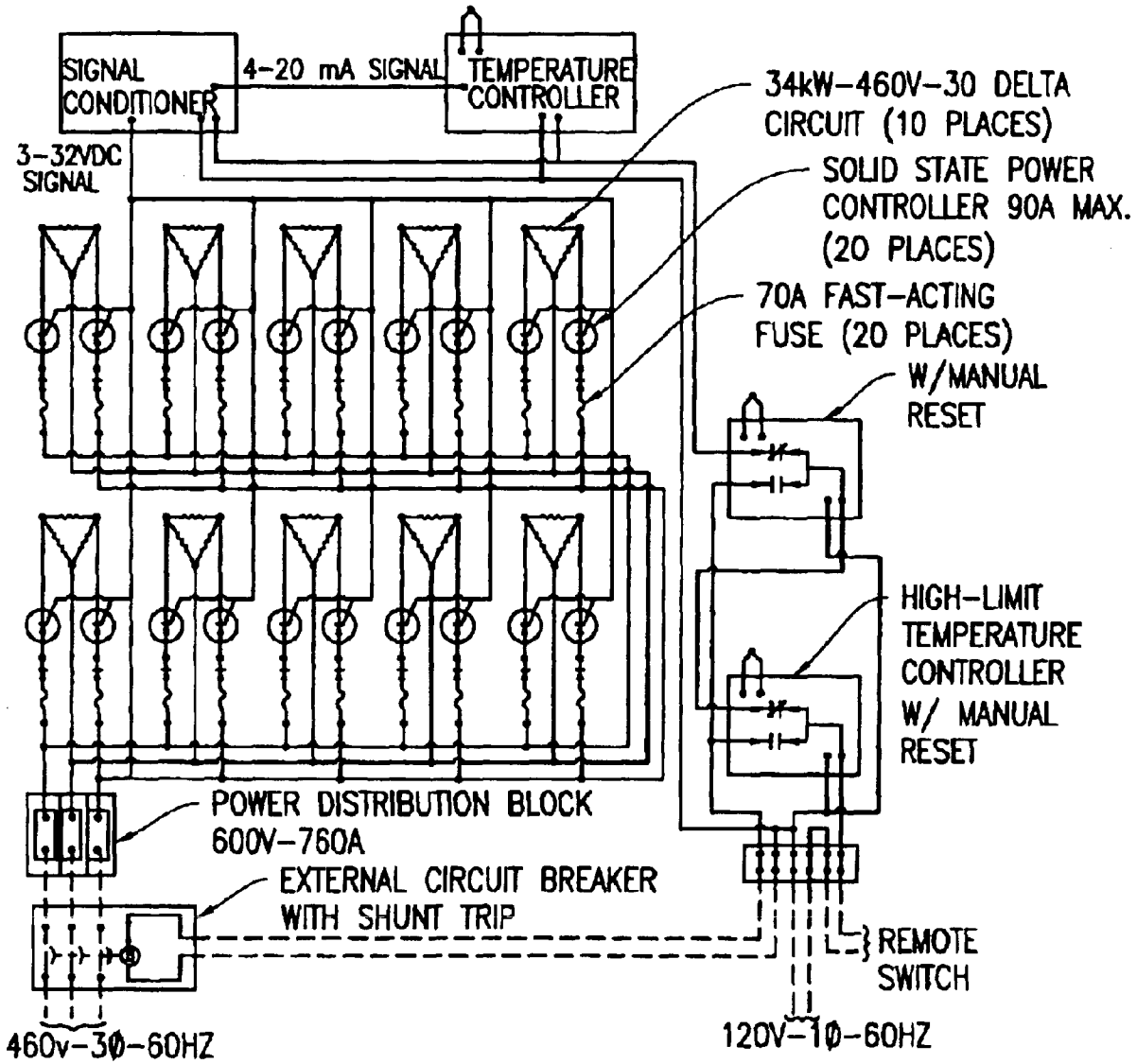
Figure 4:
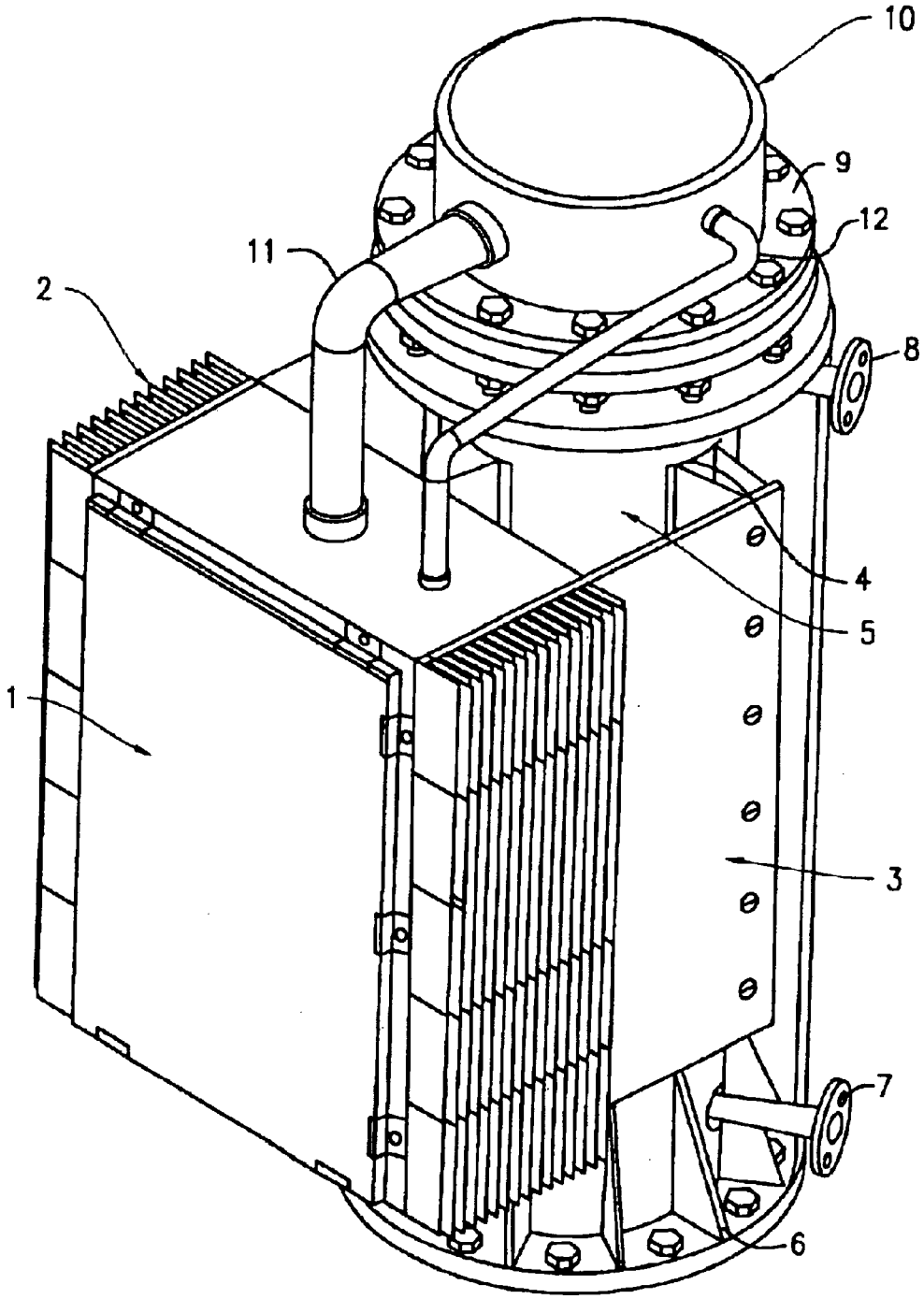
Figure 5:
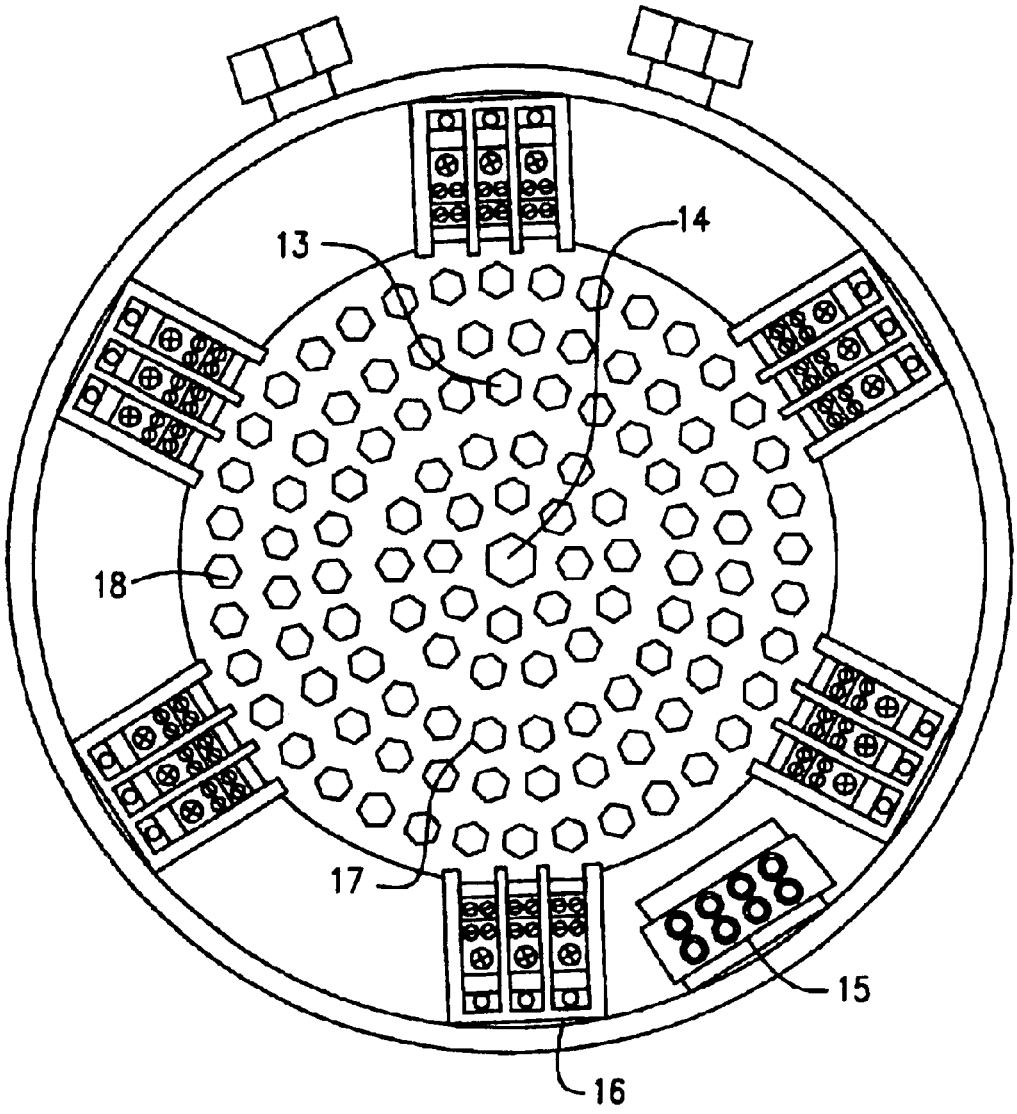
FIG. 5 is a top view of heater unit (6) with the cover removed. The view includes high limit thermocouple (13) with standard size quick disconnect, low water probe (14), low water terminal connection board (15) power distribution block (16) temperature controller thermocouple probe (17) with standard size quick disconnect and replaceable heating elements (18).
Figure 6:
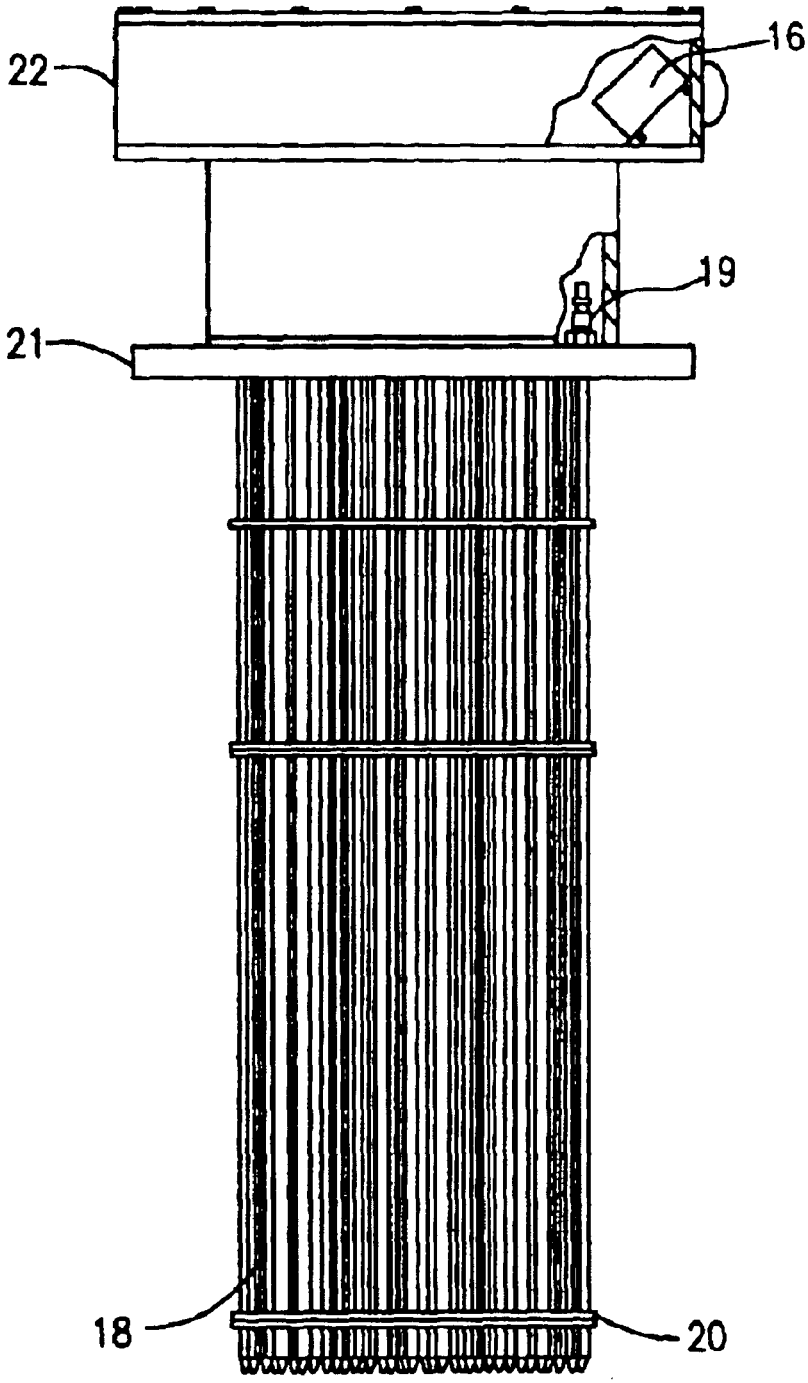
FIG. 6 is a cut away side view of heater unit (6) including power distribution block (16) in six places, hermetic seal (19), element spacers (20) replaceable heating elements (18) element flange (21) and moisture resistant terminal enclosure.

While the particular water heaters as herein shown and disclosed in detail are fully capable of obtaining the objects and presently preferred embodiments of the invention and that no limitations are intended to the details of structure or operation herein shown other than as described in the appended claims.

What is claimed is:

1. A pressurized demand water heating device for the direct heating of output water having an electrical conductivity, comprising (a) a vessel having top and bottom ends and side walls and provided with a water inlet and water outlet and a lid closing the top of said vessel and defining a space therebetween, one or a plurality of closely-spaced individually removable non-hairpinned electrodes extending substantially parallel to each other substantially vertically across the vessel between said top and said bottom ends, and electrical terminals located in the space provided between said vessel top and said lid for connection of said electrodes to a source of electrical power, (b) switching means for selectively connecting one or more of said electrodes to a source of electrical power wherein the electrodes switch on only when water flow through the heating device commences whereby water may be heated directly by passage of the electric current therethrough, (c) transducer means operatively responsive to the electric current for controlling the switching means.

2. A pressurized demand water heating device as claimed in claim 1 in which the electrodes are hermetically sealed and designed with a maximum watt density of 50 watts per square inch and can be inserted or removed individually from the dry side of the vessel top without draining water from the vessel.

3. A pressurized demand water heating device as claimed in claim 1, in which a transducer means comprises a means for monitoring water temperature within the heating device.

4. A pressurized demand water heating device as claimed in claim 1, in which a transducer means comprises a means for detecting water overtemperature in the water heating device.

5. A pressurized demand water heating device as claimed in claim 3, in which the transducer means is a thermocouple.

6. A pressurized demand water heating device as claimed in claim 4, in which the transducer means is a thermocouple.

7. A pressurized demand water heating device as claimed in claim 1, in which the switching means comprises suitable solid state circuitry.

8. A pressurized demand water heating device as claimed in claim 1 characterized in that said vessel is cylindrical.

9. A pressurized demand water heating device as claimed in claim 7, wherein said switching means is capable of switching elements on/off with full proportional control.

10. A pressurized demand water heating device as claimed in claim 1 including an internal element spacer to ensure proper electrode placement within the heating device.

* * * * *